United States Patent [19]

Briosi

[11] Patent Number: 5,036,778

[45] Date of Patent: Aug. 6, 1991

[54] ASSEMBLABLE MODULAR ELEMENTS, IN PARTICULAR IN THIN SHEET, FOR THE FORMATION OF A METAL SHELVING

[76] Inventor: Antonello Briosi, via Balteri n. 12/D, 38068 Rovereto (Trento), Italy

[21] Appl. No.: 496,766

[22] Filed: Mar. 21, 1990

[51] Int. Cl.[5] ..... A47B 9/00

[52] U.S. Cl. ..... 108/110; 108/111; 211/187

[58] Field of Search ..... 108/110, 111, 107, 157; 211/187, 189, 192, 206, 207

[56] References Cited

U.S. PATENT DOCUMENTS

| | | | |
|---|---|---|---|
| 3,318,462 | 5/1967 | Spiegl et al. | 211/206 |
| 4,317,523 | 3/1982 | Konstant | 211/187 |
| 4,821,649 | 4/1989 | Anderson | 108/111 |

FOREIGN PATENT DOCUMENTS

| | | | |
|---|---|---|---|
| 1575223 | 1/1973 | German Democratic Rep. | 211/191 |

*Primary Examiner*—Kenneth J. Dorner
*Assistant Examiner*—Gerald A. Anderson
*Attorney, Agent, or Firm*—Bucknam and Archer

[57] ABSTRACT

Assemblable modular elements are described, particularly in thin sheet, suitable for the formation of a metal shelving. The modular elements in question essentially comprise substantially tubular box-shaped bodies of generally rectilinear shape, which, on their upper face, are equipped with a longitudinal groove suitable to receive the folded or squashed end side of further elements forming supporting shelves. Said box-shaped bodies are also equipped, on their projecting portions, with openings suitable to receive corresponding projecting portions of further substantially rectilinear tubular elements forming the uprights of the shelving.

A substantially elongated, rectilinear element equipped at the ends with at least one opening suitable to receive the projecting portions of the uprights, forming in this way a spacer of the shelving, also forms the object of the invention. Another assenblies element according to the invention is a containing body of substantially tray shape, equipped at the end with a folded edge suitable to be inserted and housed in the longitudinal groove of the crosspiece. The above elements are equipped with ribs and/or folded and/or superposed stiffening parts to increase their flexural strength.

10 Claims, 3 Drawing Sheets

Fig. 6
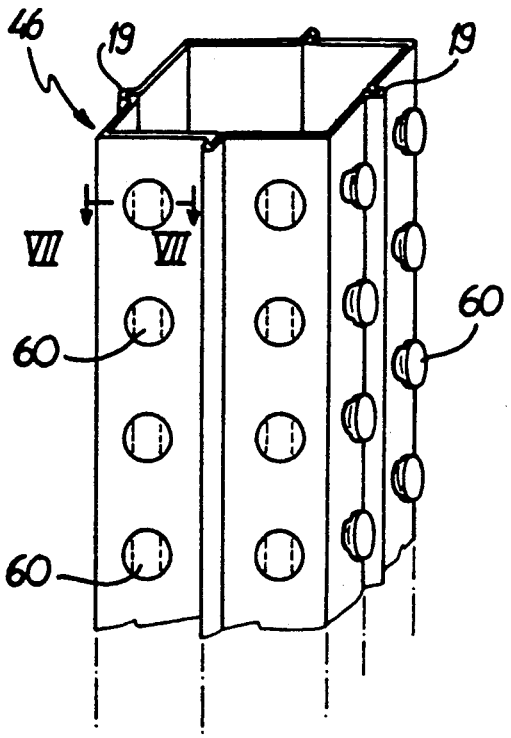
Fig. 9
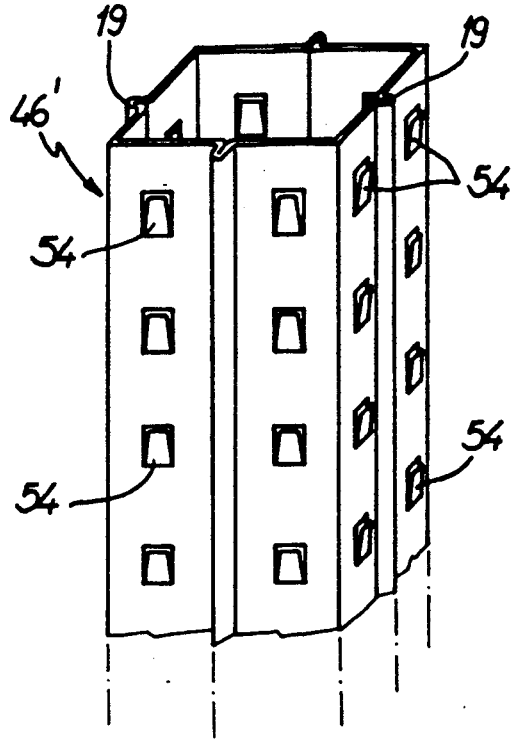
Fig. 7
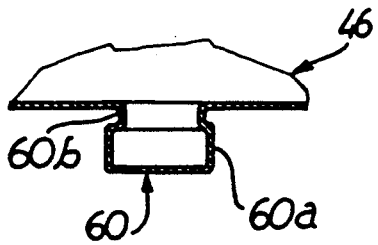
Fig. 8
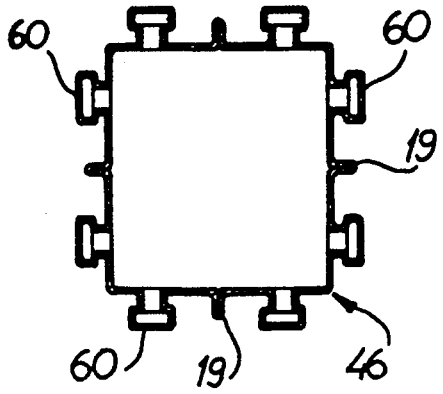
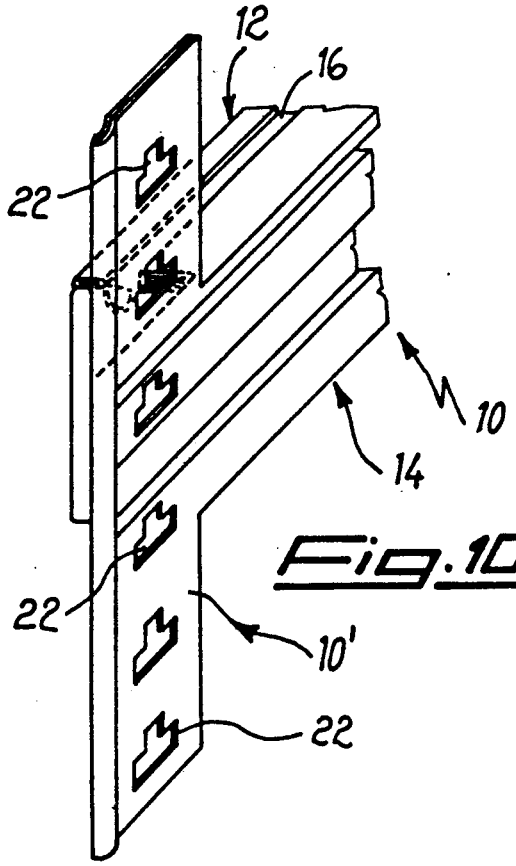
Fig. 10

ASSEMBLABLE MODULAR ELEMENTS, IN PARTICULAR IN THIN SHEET, FOR THE FORMATION OF A METAL SHELVING

DESCRIPTION

The object of the present invention is assemblable modular elements, in particular in thin sheet, for the formation of a metal shelving. Assemblable elements for the construction of a metal shelving are known. The traditional elements present considerable problems, however, which regard both the formation of to the shelving and any modifications which the user wishes to make to it.

It is known, in fact, that a first limitation of the shelvings of known type lies in the fact that they are lengthy and complicated to construct, as the elements which compose them are assemblable with the use of bolts, screws and the like, which involve the use of special tools not always available or at any rate compatible with the type of the locking members used. Another problem of the traditional shelvings, closely linked with the above limitation, consists of the fact that any modifications to be made to the shelving force the user to dismantle and re-assemble the abovementioned bolts, screws and the like, which involves annoying or difficult operations. The above problems are particularly accentuated by the fact that the most frequent user of the shelving is a person of "do-it-yourself" type who rarely has the experience and the skill of an operator who possesses the necessary practicality of these assemblies.

Other known elements for the formation of a shelving are assemblable to one another by means of the substantially jointed connection of their parts or portions preliminarily cut, generally by shearing with partial removal of material and suitably shaped, thus permitting the assembly of the shelving without the use of screws or the like.

Also in this case the abovementioned elements, while eliminating the abovementioned disadvantages deriving from the use of screws or the like for their assembly, present the notable drawback of forming a shelving weakened by the partial removals of material for the formation of the abovementioned joints and therefore not sufficiently stiff to withstand the flexural stress to which the shelving is subject, with evident notable limitations in the use of same.

Modular assemblable elements, particularly in thin sheet, have now been invented, and form the object of the present invention, which make it possible to solve the problems of the traditional elements. The characteristics and advantages of the elements for metal shelving according to the present invention will be evident from the following detailed description of an unbinding constructive form, made with reference to the enclosed figures, of which:

FIG. 6 is a view showing a fifth modular element according to the invention suitable to form an upright of the shelving;

FIG. 7 is a view of one of the projections highly similar to a "mushroom" of the upright according to section VII—VII of FIG. 6;

FIG. 8 is a cross-section of the upright of FIG. 6; and

FIG. 9 is a partial sonometric view showing a final variant of the upright of FIG. 6; and FIG. 10 is a fragmentary perspective view of a constructive variant of the end of the crosspiece of FIG. 2.

Figure 1:
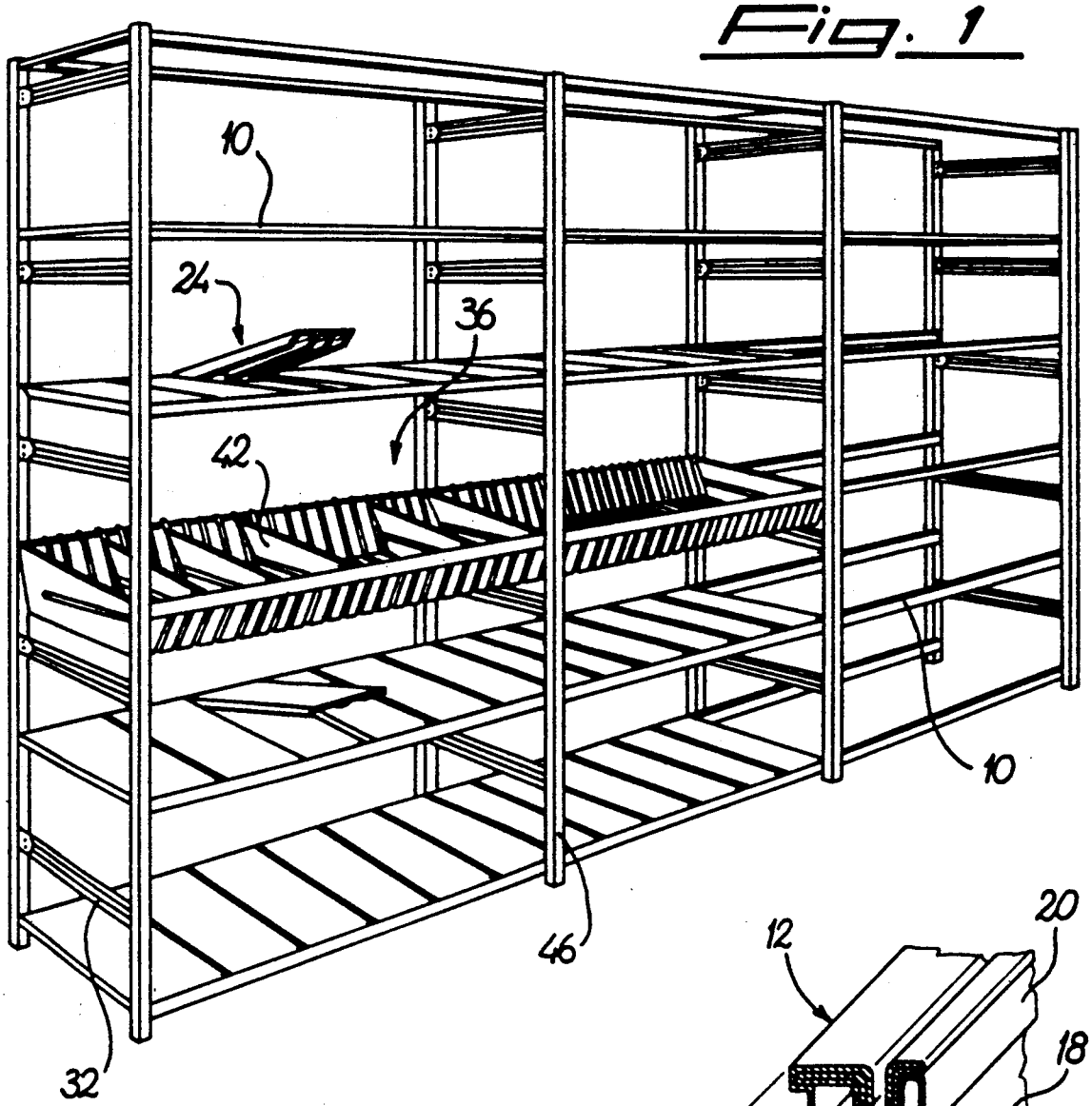
FIG. 1 is a schematic perspective view of a shelving constructed with the elements according to the present invention.
Figure 2:
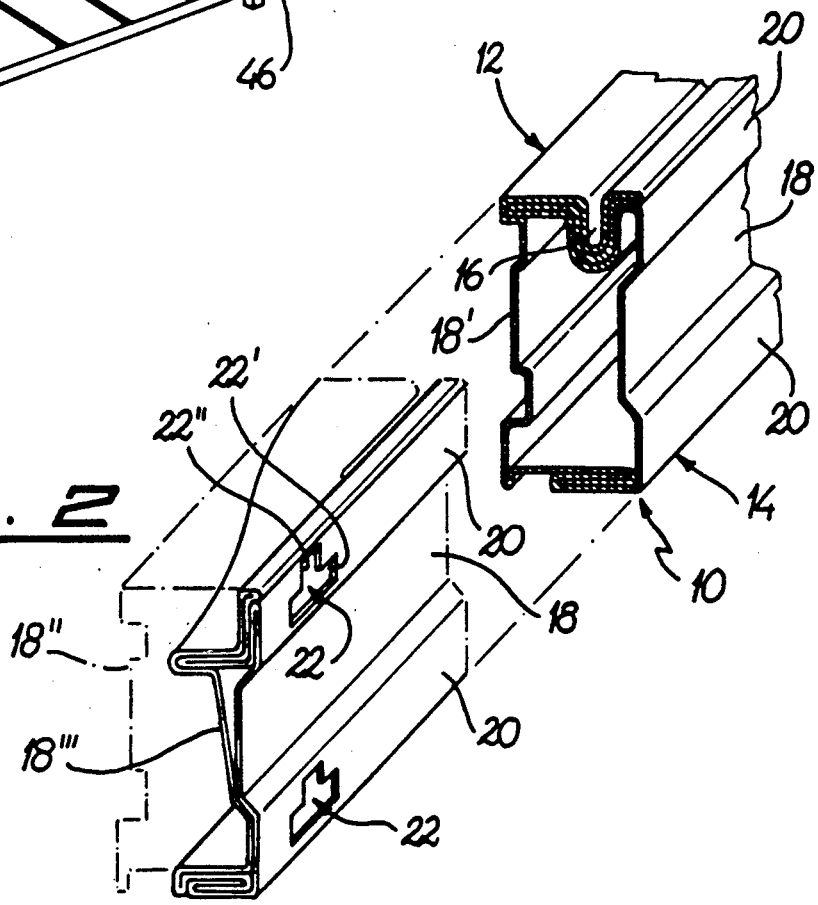
FIG. 2 is a fragmentary perspective view, partially sectioned, of the end of a first element according to the invention suitable to form a crosspiece of the shelving.

First making particular reference to FIGS. 1 and 2, a description follows of the first modular element according to the invention suitable to form one of the crosspieces of the shelving.

With reference to the above figures, the abovementioned element is essentially formed by a substantially tubular and box-shaped body, indicated as a whole with 10, with a substantially rectangular cross-section. The substantially tubular body 10 presents, in particular on its upper and lower face 12, 14 folded and superposed portions suitable to form a stiffening of its structure to increase its flexural strength, particularly when its length becomes notable. The box-shaped body 10 presents in particular, on its upper face, a substantially U-folded portion suitable to form a seat and housing for further modular elements according to the invention, of which more will be said later. The box-shaped body 10 also presents, on its front face 18, some folded parts 20 in which shaped openings 22 have been obtained, which in particular permit the composition of the crosspiece 10 with the uprights of the shelving which will be described later.

Figure 3:
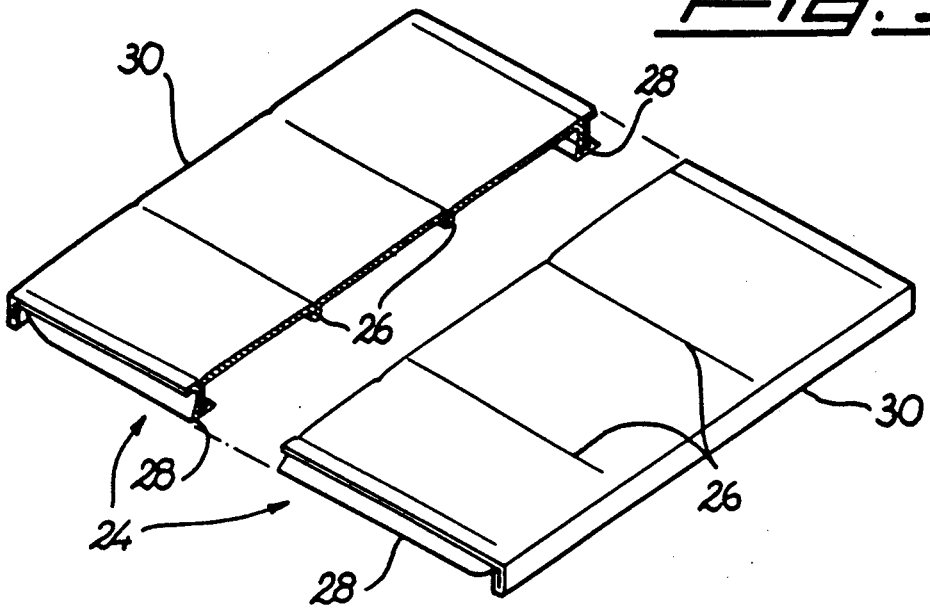
FIG. 3 is a schematic perspective view with partial removal of a second element according to the invention, suitable in particular to form a shelf of the shelving.

Making particular reference to FIG. 2, we note that a portion of the end of the rear face 18'—indicated with dotted line 18''—of the crosspiece 10, is partially squashed, as indicated with continuous line 18''', so that the material is superposed at the folded parts 20 of the front face 18 in which are obtained the abovementioned shaped openings 22, formed by a portion 22' with larger cross-section and by a portion with smaller cross-section 22'' for the purposes specified below. The superposition of the material at the shaped openings 22 permits the tubular body of the crosspiece 10 to increase considerably the mechanical strength of the crosspiece installed. With particular reference to FIGS. 1 and 3, a description follows of the second element according to the invention. The abovementioned element is, in particular, suitable to form one of the shelves of the shelving. With reference to the above-mentioned figures, said second element is formed by a substantially flat plate 24, always in thin sheet, which is equipped with small projections or folded stiffening parts 26 which extend longitudinally.

The side edges of the plate 24 present a multiple fold 28, which, like the projections 26, forms a stiffening element of the plate 24 suitable to give the shelf a greater flexural strength, permitting it to be constructed in suitable length. With particular reference to FIG. 3, we see that the end sides 30 of the plate 24 forming the shelf of the shelving have a downward extension which is squashed to increase the flexural strength of the shelf, and, in particular, to form a portion suitable to be inserted in the groove 16 of the first element according to the invention shown in FIG. 2 and forming the crosspiece of the shelving.

Figure 4:
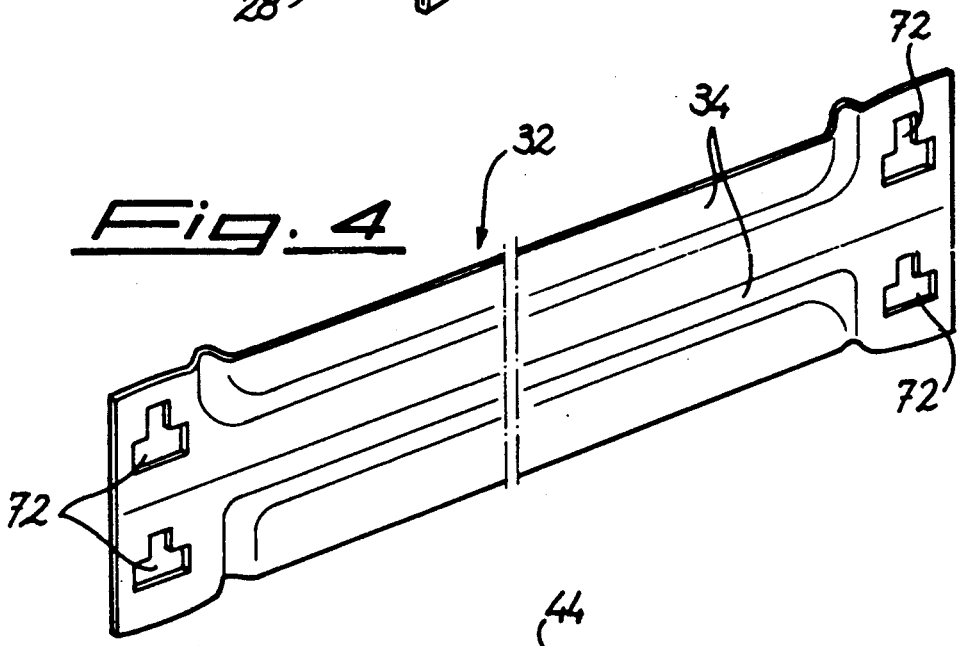
FIG. 4 is a perspective view, with partial removal of a third element according to the invention, suitable to form a spacer between a front and a rear upright.

With particular reference to FIGS. 1 and 4, a description follows of the third element according to the invention suitable in particular to form the spacer between a front and a rear upright. The abovementioned element is formed by a substantially rod-shaped body, indicated as a whole with 32, which is equipped with longitudinal reinforcing ribs 34 to increase its flexural strength.

Also the abovementioned rod-shaped body 32 is equipped, at its ends, with openings 22, suitable to receive means of support of the upright of the shelving, which will be described later, as already mentioned further above for the first and third element of the invention.

Figure 5:
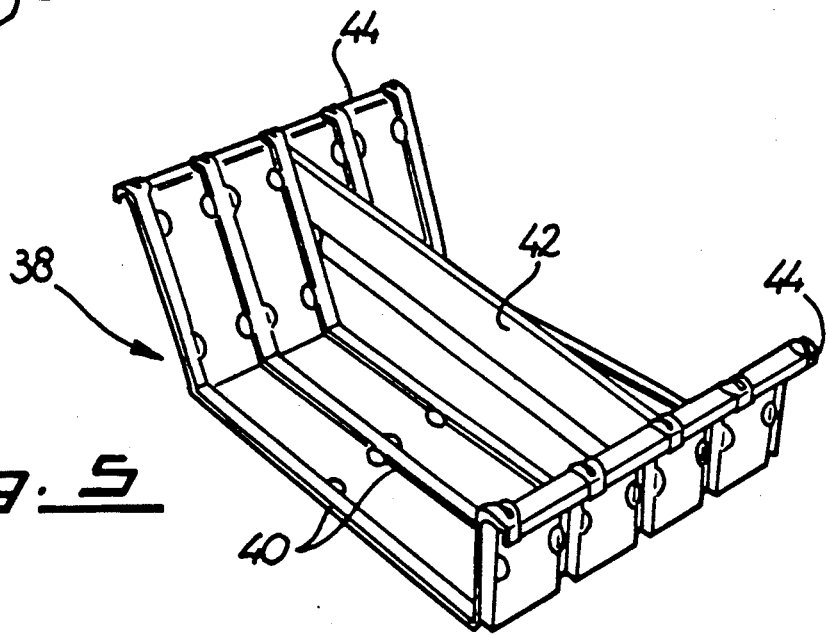
FIG. 5 is a schematic perspective view showing a fourth modular element according to the invention, formed substantially by a tray container applicable to the crosspieces of the shelving.

Making particular reference to FIG. 5, a description follows of the fourth element according to the invention, substantially forming a tray container to house small metal parts, tools and the like. The abovementioned element, indicated as a whole with 38, is formed by a substantially U-shaped body with the end sides inclined towards the exterior and equipped with longitudinal ribs 40 for stiffening, which also permit the application of removable partitions 42. Always with particular reference to FIG. 5, said containing body 38 presents its end sides 44 folded downwards, to form a stiffening element of its structure, and, in particular, to form a portion suitable to be inserted in the longitudinal groove 16 of the crosspiece 10. With particular reference to FIGS. 1 and 6, description follows of the fifth modular element according to the invention for construction of the shelving. The abovementioned element is, in particular, suitable to form the upright of the shelving.

From FIG. 6 we see that said element is formed by a body, indicated as a whole with 46, essentially tubular, with a cross-section which, in the illustrative form considered, is of substantially square shape, but which could be generally polygonal with a different number of sides from that illustrated.

On the faces of the upright 46, as is noted in particular from the two exposed faces of FIG. 6, two series of projections are obtained, indicated with 60 and similar to a "mushroom", aligned in substantially parallel directions to the longitudinal axis of the upright 46, each of which forms one of the engaging and connecting means with the crosspiece 10. With particular reference to FIGS. 7 and 8, we see that the projections 60 of the upright 10 present a "head" 60*a*, of larger cross-section and of essentially round shape, which is connected to a portion or "shank" 60*b* of smaller cross-section. This last portion, in particular, presents two opposite walls, which are parallel to one another or slightly conic.

Characteristically all the abovementioned projections 60 are obtained, for example, by drawing without removal of material, so the upright remains integral and maintains a high resistance to stress.

This characteristic must be considered valid even if the various projections 60 mentioned above are hollow, as the non-removal of the material makes them particularly resistant to even high stress.

Furthermore, the upright 46 presents, on each of its four faces, a substantially central longitudinal rib 19, obtained by folding and superposition of the sheet forming the wall of the upright 46 which increases its mechanical strength. The connection of the crosspiece 10 to the upright 46 is easily carried out inserting the heads 60*a* of the projections 60 in the portions with larger cross-section 22' of the opening 22 then inserting the shank 60*b* of the same projections in the portions with smaller cross-section 22'' of the abovementioned openings 22 preferably with slight force.

Referring to FIG. 9, a description follows of a constructive variant of the upright of FIG. 6.

Said upright is formed by a tubular body 46', substantially similar to that illustrated in the abovementioned FIG. 6, but presents, on each of its faces, two series of projecting portions 54, obtained for example by shearing or the like, aligned in substantially parallel directions to the axis of the upright 46' and suitably "tooth"-shaped to be inserted in the opening of the first and third modular element according to the invention, shown in FIGS. 2 and 4.

With reference to FIG. 10 a constructive variant is illustrated of the end of the crosspiece of FIG. 2.

According to this variant a vertical side of the substantially tubular body of the crosspiece 10 extends in a wall or connecting flange 10' on which are obtained a plurality of the abovementioned openings 22 suitable to receive a coherent plurality of projecting portions 60 and/or 54 of the upright 46 and/or 46', thus obtaining an efficient bond between cross-piece and upright in the assembly of the shelving.

Characteristically, the wall or connecting flange 10' is obtained by the stretching, after partial shearing, of part of the folded and superposed portions of the upper and lower face 12, 14 of the tubular body of the crosspiece 10, which will therefore take up, at its end, a horizontal "T" conformation. From the above the advantages are evident of assembling the modular elements according to the present invention in the formation of a shelving, and, in particular, the insertion of the projecting portions 60 and/or 54 in the openings 22 demonstrates the facility of composition of said shelving, which does not need the use of locking means like traditional shelvings, so the formation of the shelving and its possible modification are extremely easy.

It is clear, finally, that variants and/or modifications may be made to the modular elements according to the present invention, without leaving the field of protection of this invention.

I claim:

1. An assemblable modular structure in thin sheet comprising at least two front and two rear uprights (46), at least two crosspieces (10) engageable with said uprights, one crosspiece extending between said two front uprights and one crosspiece extending between said two rear uprights, a spacer (32) extending between one front and a rear upright and engageable therewith, a horizontal shelf (24) having squashed and folded end sides (30) and a tray (38) having folded edges (44), said shelf and said tray being engageable with said crosspieces, each of said uprights having a square cross section and four faces and each said face having a central longitudinal rib (19) and first projections (60) essentially of mushroom shape on each face, each projection being formed by a round head (60*a*) and a shank (60*b*), said crosspiece (10) being formed by an essentially tubular box-shaped body having an upper face (12), a lower face (14) a front face (18) and a rear face (18'), said upper face (12) having a groove (16) capable of seating said squashed and folded end sides (30) of said supporting shelf (24) and said folded edges (44) of said tray (38), said crosspiece (10)

presenting strengthening second projections (20) on said front face, said second projections having first openings (22), said first projections (60) of each of said uprights engaging with said first openings (22) in said crosspiece, said spacer (32) having second openings (72) at the ends thereof, said first projections (60) of the upright (46) being inserted in said second openings to fix the spacing at the ends of said spacer (32).

2. The assemblable modular structure according to claim 1 wherein said shank (60*b*) has two substantially parallel vertical walls and said first projections (60) are obtained by drawing said upright from a metal sheet material and drawing said shank without removal of said metal sheet.

3. The assemblable modular structure according to claim 1 wherein said upper face (12) and lower face (14) of said crosspiece have folded and superposed portions to increase the stiffness and flexural strength of said crosspiece.

4. The assemblable modular structure according to claim 1 wherein said crosspiece has a wall and said second projections (20) of the crosspiece (10) are formed by folds towards the exterior or towards the interior or both towards the exterior and towards the interior of the wall of the crosspiece, thereby stiffening ribs are formed which increase the flexure of said crosspiece (10).

5. The assemblable modular structure according to claim 1 wherein said tubular box-shaped body of the crosspiece (10) has a portion (18″) of its rear face (18′) squashed so as to substantially approach said front face (18) of said crosspiece.

6. The assemblable modular structure according to claim 1 wherein said first openings (22) are formed by a portion (22′) with larger cross-section and a portion (22″) of smaller cross-section.

7. The assemblable modular structure according to claim 1 wherein the shelf (24) has small third longitudinal stiffening projections (26) whereby the stress resistance of said shelf (24) is increased.

8. The assemblable modular structure according to claim 1 wherein said tray (38) has essentially longitudinal ribs (40) whereby the stress resistance of said tray is increased.

9. The assemblable modular structure according to claim 8 wherein said tray has partitions and said partitions are supported by said longitudinal ribs.

10. The assemblable modular structure according to claim 1 wherein the spacer (32) has second longitudinal ribs (34) whereby the stress resistance of said spacer is increased.

* * * * *